US009260774B2

(12) United States Patent
Hoshino et al.

(10) Patent No.: US 9,260,774 B2
(45) Date of Patent: Feb. 16, 2016

(54) METHOD FOR MANUFACTURING HOT DIP GALVANIZED STEEL SHEET

(75) Inventors: Katsuya Hoshino, Tokyo (JP); Takahiro Kubota, Tokyo (JP); Masahiko Tada, Tokyo (JP); Masayasu Nagoshi, Tokyo (JP); Wataru Tanimoto, Tokyo (JP); Hideo Kijima, Tokyo (JP); Kazuhiko Higai, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 586 days.

(21) Appl. No.: 13/638,188

(22) PCT Filed: Mar. 14, 2011

(86) PCT No.: PCT/JP2011/001481

§ 371 (c)(1),
(2), (4) Date: Nov. 28, 2012

(87) PCT Pub. No.: WO2011/121910

PCT Pub. Date: Oct. 6, 2011

(65) Prior Publication Data

US 2013/0086960 A1 Apr. 11, 2013

(30) Foreign Application Priority Data

Mar. 31, 2010 (JP) ..... 2010-080878

(51) Int. Cl.
*C23C 2/06* (2006.01)
*C23C 2/26* (2006.01)
(Continued)

(52) U.S. Cl.
CPC ... *C23C 2/26* (2013.01); *C23C 2/06* (2013.01); *C23C 28/025* (2013.01); *B21B 1/22* (2013.01); *B21B 2001/228* (2013.01)

(58) Field of Classification Search
CPC ..... C23C 2/06; C23C 2/26; B21B 1/22; B21B 2001/228
See application file for complete search history.

(56) References Cited

U.S. PATENT DOCUMENTS

2005/0139291 A1 6/2005 Taira et al.

FOREIGN PATENT DOCUMENTS

CN 1423708 A 11/2003
CN 1692175 A 11/2005
(Continued)

OTHER PUBLICATIONS

Chinese Office Action dated Dec. 9, 2013, application No. 201180022488.2 with English Translation.

(Continued)

*Primary Examiner* — Lois Zheng
(74) *Attorney, Agent, or Firm* — RatnerPrestia

(57) ABSTRACT

An object of the present invention is to make it possible, without necessitating an alkali pretreatment, to form a zinc oxide layer having excellent sliding properties on a hot dip galvanized steel sheet not subjected to alloying after galvanizing and thus having a relatively low degree of surface activity. Another object of the present invention is to make it possible to manufacture a hot dip galvanized steel sheet having higher area ratio of Zn oxide layer formed on a coating surface and larger thickness of the Zn oxide layer. Specifically, the present invention provides a method for manufacturing a hot dip galvanized steel sheet comprising: subjecting a steel sheet to hot dip galvanizing and subsequent temper rolling; bringing the steel sheet into contact with acidic solution having pH buffering capacity; retaining the steel sheet for 1 second to 60 seconds after the contact with the acidic solution; and rinsing the steel sheet with water, to form a zinc oxide layer on a coating surface of the steel sheet, characterized in that the method further comprising:

carrying out the temper rolling by either rolling the steel sheet first with a dull roll having Ra≥2.0 μm at rolling reduction rate ≤5% and then with a bright roll having Ra≤0.1 μm at rolling reduction rate ≤3% or rolling the steel sheet first with a bright roll having Ra≤0.1 μm at rolling reduction rate ≤3% and then with a dull roll having Ra≤2.0 μm at rolling reduction rate ≤5%.

5 Claims, 2 Drawing Sheets

(51) Int. Cl.
*C23C 28/02* (2006.01)
*B21B 1/22* (2006.01)

(56) References Cited

FOREIGN PATENT DOCUMENTS

| | | | |
|---|---|---|---|
| EP | 1288325 | A1 | 3/2003 |
| JP | 64-083306 | A | 3/1989 |
| JP | 02-175004 | A | 7/1990 |
| JP | 2002-256448 | A | 9/2002 |
| JP | 2003-306781 | A | 10/2003 |
| JP | 2004-003004 | A | 1/2004 |

OTHER PUBLICATIONS

International Preliminary Report on Patentability for International Application No. PCT/JP2011/001481 dated Nov. 13, 2012.

Korean Office Action dated Feb. 27, 2014, application No. 10-2012-7028365 with English Translation.

Chinese Office Action dated Jul. 3, 2014, application No. 201180022488.2 with English Translation.

Korean Office Action dated Aug. 13, 2014, application No. 10-2012-7028365.

Taiwan Office Action dated Sep. 4, 2013, application No. 100108764.

International Search Report dated May 17, 2011, application No. PCT/JP2011/001481.

METHOD FOR MANUFACTURING HOT DIP GALVANIZED STEEL SHEET

CROSS REFERENCE TO RELATED APPLICATIONS

This application is a National Phase Application of International Application No. PCT/JP2011/001481, filed Mar. 14, 2011, which claims priority to Japanese Application No. 2010-080878, filed Mar. 31, 2010, the contents of which applications are incorporated herein by reference in their entireties for all purposes.

TECHNICAL FIELD

The present invention relates to a method for manufacturing a hot dip galvanized steel sheet excellent in press formability and handling properties in a coiled state.

PRIOR ART

A molten zinc or zinc alloy-coated steel sheet (which will be referred to as a "hot dip galvanized steel sheet" in the present invention) is widely in use in various fields and vigorously applied to an automobile body in particular. A hot dip galvanized steel sheet is generally press formed for use in such applications as described above. A (hot dip) galvanized steel sheet, however, has a defect that it exhibits poorer press formability than a cold rolled steel sheet. This defect results from a fact that a galvanized steel sheet exhibits higher sliding friction in a press forming die than a cold rolled steel sheet does. That is, there arises a problem in a galvanized steel sheet that smooth introduction of the steel sheet into a press forming die is disturbed at a portion where sliding resistance increases between the press forming die and a bead, which may trigger fracture of the steel sheet.

A galvanized steel sheet is either further subjected to alloying treatment after coating or allowed to skip alloying treatment. The present invention collectively refers these two types of galvanized steel sheets to "(hot dip) galvanized steel sheets". When these two types of galvanized steel sheets are to be distinguished from each other, a galvanized steel sheet further subjected to alloying treatment after coating is referred to as a "GA steel sheet" and a galvanized steel sheet skipping alloying treatment is referred to as a "GI steel sheet".

A GI steel sheet in particular experiences a phenomenon in which sliding resistance increases due to coating attaching to an inner surface of a die (i.e. "die galling"), which phenomenon may cause fairly serious negative effects on productivity of automobiles by e.g. inducing generation of cracks in the midst of continuous press forming of a steel sheet. Further, there has been a trend in view of recent strict $CO_2$ emission control toward using a high strength steel sheet at an increasingly high ratio in order to reduce vehicle body weight. In a case where a high strength steel sheet is used, the problem of coating attachment to a die worsens due to increased contact pressure during press forming.

JP 2002-256448 and JP 2003-306781, aiming at solving the aforementioned problem, each disclose a technique of bringing a GA steel sheet into contact with an acidic solution having pH buffering capacity after temper rolling, leaving the steel sheet for 1 to 30 seconds after the contact with the acidic solution, then rinsing the steel sheet with water and drying the steel sheet, so that zinc(-based) oxide is formed on a surface layer of the GA steel sheet to improve press formability thereof.

It should be noted in this regard that a hot dip galvanizing bath generally contains a small amount of aluminum for adjusting alloying reaction between base iron and zinc, whereby aluminum oxide derived from Al in the galvanizing bath exists at a surface of a resulting galvanized steel sheet. A GI steel sheet has higher concentration of such Al oxide at a surface thereof than a GA steel sheet and thus exhibits a particularly low degree of surface activity in terms of formation of the aforementioned zinc oxide thereon.

In view of this, JP 2004-003004 discloses as a method for facilitating formation of the aforementioned zinc oxide on a GI steel sheet having a low degree of surface activity in particular a method of removing Al oxide on a surface of a GI steel sheet by bringing the GI steel sheet into contact with an alkali solution prior to contact with an acidic solution, thereby activating the surface of the GI steel sheet to facilitate formation of zinc oxide thereon.

DISCLOSURE OF THE INVENTION

Problems to be Solved by the Invention

When zinc oxide is to be formed on a surface of a GI steel sheet having a relatively low degree of surface activity, the GI steel sheet needs to be subjected to an alkali pretreatment, e.g. bringing the GI steel sheet into contact with alkali solution, to remove Al oxide on the surface of the GI steel sheet as disclosed in JP 2004-003004. That is, alkali pretreatment facilities must be newly built if the existing manufacturing facilities lack them in the method of JP 2004-003004. In other words, according to JP 2004-003004, a GI steel sheet having zinc oxide adequately formed on surfaces thereof cannot be manufactured by a production line which is incapable of including alkali pretreatment facilities in terms of the line layout thereof.

Further, it is preferable that a zinc oxide layer on a surface of a GI/GA steel sheet is sufficiently thick and the area ratio of the zinc oxide layer thus formed is sufficiently high in terms of improving sliding properties of the steel sheet during press forming. In a case where the alkali pretreatment is not carried out, however, the zinc oxide layer will be too thin and the area ratio of the layer will be too low.

A first object of the present invention is to solve the aforementioned problem and provide a method for manufacturing a hot dip galvanized steel sheet, which method enables a zinc oxide layer having excellent sliding properties to be formed on a GI steel sheet surface with a relatively low degree of surface activity without necessitating an alkali pretreatment.

A second object of the present invention is to provide a method for manufacturing a hot dip galvanized steel sheet, which method enables increasing both area ratio and thickness of a zinc oxide layer formed on a surface of a GI/GA steel sheet (the method is to work on both a GI steel sheet and a GA steel sheet).

Means for Solving the Problem

The inventors of the present invention, as a result of a keen study to achieve the aforementioned objects, discovered that in a method for manufacturing a hot dip galvanized steel sheet including: subjecting a steel sheet to hot dip galvanizing and subsequent temper rolling; bringing the steel sheet into contact with acidic solution having pH buffering capacity; retaining the steel sheet for 1 second to 60 seconds after the contact with the acidic solution; and rinsing the steel sheet with water, to form a zinc oxide layer on a coating surface of the steel sheet, it is possible to activate the coating surface by carrying out the temper rolling by using both a dull roll and a bright roll and as a result a sufficient amount of zinc oxide can be formed on the coating surface without necessitating an alkali pretreatment.

The present invention has been contrived based on this discovery. Primary features of the present invention to achieve the aforementioned objects are as follows.

[1] A method for manufacturing a hot dip galvanized steel sheet comprising: subjecting a steel sheet to hot dip galvanizing and subsequent temper rolling; bringing the steel sheet into contact with acidic solution having pH buffering capacity; retaining the steel sheet for 1 second to 60 seconds after the contact with the acidic solution; and rinsing the steel sheet with water, to form a zinc oxide layer on a coating surface of the steel sheet, characterized in that the method further comprising: carrying out the temper rolling by either rolling the steel sheet first with a dull roll having Ra≥2.0 μm at rolling reduction rate ≤5% and then with a bright roll having Ra≤0.1 μm at rolling reduction rate ≤3% or rolling the steel sheet first with a bright roll having Ra≤0.1 μm at rolling reduction rate ≤3% and then with a dull roll having Ra≤2.0 μm at rolling reduction rate ≤5%.

[2] The method for manufacturing a hot dip galvanized steel sheet of [1] above, wherein the acidic solution having pH buffering capacity is an acidic solution containing at least one type of substance selected from acetic acid salt, phthalic acid salt, citric acid salt, succinic acid salt, lactic acid salt, tartaric acid salt, boric acid salt, phosphoric acid salt and sulfuric acid salt, and pH of the acidic solution is in the range of 1.0 to 5.0.

[3] The method for manufacturing a hot dip galvanized steel sheet of [1] or [2] above, further comprising: setting coating weight of liquid film of the acidic solution having pH buffering capacity on a coating surface of the steel sheet when contact of the steel sheet with the acidic solution is completed to be 15 g/m$^2$ or less.

[4] The method for manufacturing a hot dip galvanized steel sheet of any of [1] to [3] above, further comprising: subjecting a coating layer of the galvanized steel sheet to alloying treatment and then the temper rolling as described in [1] above.

Effect of the Invention

According to the method for manufacturing a hot dip galvanized steel sheet of the present invention, it is possible to stably form by carrying out an adequate temper rolling process a zinc oxide layer having excellent sliding properties on a GI steel sheet surface exhibiting a relatively low degree of surface activity, through zinc oxide layer formation process after the temper rolling without necessitating an alkali pretreatment. Further, it is possible to obtain adequate surface roughness Ra of the hot dip galvanized steel sheet according the present invention. As a result, it is possible to provide a hot dip galvanized steel sheet excellent in press formability and handling properties in a coiled state. Yet further, it is possible to increase both area ratio and layer thickness of a zinc oxide layer formed on a coating surface of a GI/GA galvanized steel sheet (this good effect can be obtained in both of a GI steel sheet and a GA steel sheet) according to the present invention, thereby making it possible to manufacture a hot dip galvanized steel sheet having further improved sliding properties during press forming.

BEST EMBODIMENT FOR CARRYING OUT THE INVENTION

Figure 1:
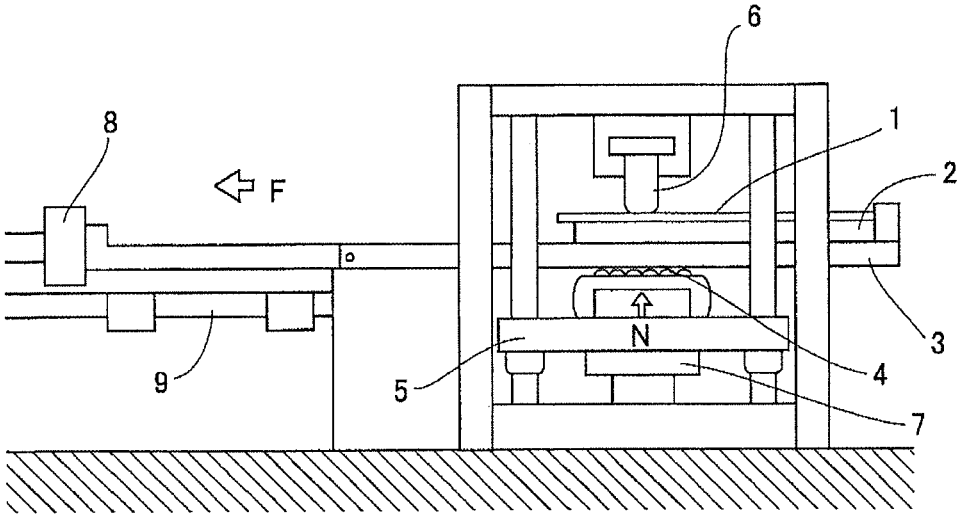
FIG. 1 is a schematic front view showing a coefficient of friction tester.

A galvanized steel sheet is generally subjected to temper rolling for ensuring desired material quality when a galvanized steel sheet is manufactured. Temper rolling is conventionally carried out by using a dull roll in a GI steel sheet which is to subjected to forming such as press forming, because a GI steel sheet not involving alloying treatment after coating has a smooth coating surface with poor lubricant oil retainability during press forming, exhibits poor formability and needs to have surfaces thereof roughened by a dull roll such that lubricant oil retainability of the surfaces improves.

A smooth coating surface of a GI steel sheet is roughened or provided with irregularities through contact with a dull roll during temper rolling and portions of the coating surface of the GI steel sheet, brought into contact with the dull roll, are formed into recessed portions of the coating surface. A coating surface of a GA steel sheet subjected to alloying treatment after coating, in contrast, has already been provided with a few μm depth irregularities through the alloying treatment when the GA steel sheet is subjected to temper rolling with a dull roll after the alloying treatment and projected portions of the irregular coating surface of the GA steel sheet are predominantly brought into contact with the dull roll. Presence of hard substance having high melting point capable of reliably preventing coating of a galvanized steel sheet from adhering to a die, on projected portions of an irregular coating surface of the galvanized steel sheet, is important in terms of improving sliding properties because such projected portions of the irregular coating surface of the galvanized steel sheet are directly in contact with a die during press forming. In this regard, an oxide layer formed on a coating surface layer prevents the coating surface layer from adhering to a die and thus effectively improves sliding properties of a galvanized steel sheet.

Such an oxide layer formed on a coating surface layer as described above is worn and scraped off during actual press forming. An oxide layer therefore needs to be sufficiently thick and exist at a sufficiently high coverage ratio on a coating surface layer in a case where an contact area between a die and a material to be formed is relatively large in particular.

By the way, a relatively thin and continuous aluminum oxide layer is generally formed on a coating surface layer of a hot dip galvanized steel sheet. This thin Al oxide layer is not sufficient in terms of obtaining good sliding properties of the hot dip galvanized steel sheet and further formation of a relatively thick oxide layer thereon is necessary.

A zinc oxide layer can be formed on a coating surface of a hot dip galvanized steel sheet by subjecting a steel sheet to hot dip galvanizing and subsequent temper rolling, bringing the steel sheet into contact with acidic solution having pH buffering capacity, retaining the steel sheet for 1 second to 60 seconds after the contact of the steel sheet with the acidic solution is completed, and rinsing the steel sheet with water, in this regard.

The aforementioned Al oxide layer on a coating surface layer of a hot dip galvanized steel sheet is relatively stable with respect to the acidic solution and inhibits the dissolution reaction of zinc when the steel sheet is brought into contact with the acidic solution, thereby making it difficult to sufficiently form zinc oxide on portions where the Al oxide exists. This problem is conspicuous in a GI steel sheet in particular because concentration of Al oxide is relatively high in a coating surface layer of a GI steel sheet. Accordingly, the Al oxide layer must be removed prior to bringing a GI steel sheet into contact with acidic solution in order to achieve sufficient formation of zinc oxide on a coating surface layer of the GI steel sheet.

An aluminum oxide layer on a coating surface of a hot dip galvanized steel sheet is physically removed at portions of the coating surface which are brought into contact with a roll during temper rolling in a hot dip galvanized steel sheet manufacturing process. Only a dull roll is used in the conventional temper rolling. A dull roll has surface roughness or surface irregularities (Ra) of a few μm and the projected portions of the irregular roll surface of the dull roll are primarily brought into contact with a steel sheet surface, whereby only portions of a coating surface layer of a hot dip galvanized steel sheet, which are brought into contact with the dull roll, are activated and other portions of the coating surface are not activated.

In the case of a GI steel sheet, portions of a coating surface layer thereof which were brought into contact with the projections of a roll surface are formed into recessed portions (recessed relative to the surroundings) and other portions of the coating surface layer which were not brought into contact with the projections of the roll surface are formed into protruding portions (protruding relative to the surroundings). As a result, zinc oxide is formed only in the recessed or surface-activated portions of the coating surface layer, while formation of zinc oxide is suppressed in the protruding or non-surface-activated portions of the coating surface layer of the GI steel sheet when the GI steel sheet subjected to the conventional temper rolling using only a dull roll is brought into contact with acidic solution. However, not the recessed portions in which zinc oxide layers have been formed but rather the protruding portions of the coating surface layer of the galvanized steel sheet are predominantly brought into contact with a press forming die during actual press forming, whereby the zinc oxide layers formed in the recessed portions do not make so much contribution to improving press formability of the galvanized steel sheet, rendering the resulting galvanized steel sheet unsatisfactory.

In the case of a GA steel sheet, coating film thereof is mainly constituted of $\delta_1$ and thus hard (in contrast, coating film of a GI steel sheet is mainly constituted of η layer), whereby the projections of the roll surface of a dull roll are more likely to be brought into contact with the alloying-derived protrusions at a coating surface of the GA steel sheet and the coating surface is activated to some extent due to the contact even by the conventional temper rolling using a dull roll only. However, the GA steel sheet not subjected to alkali pretreatment exhibits a lower degree of surface activity and thinner thickness of a zinc oxide layer than a GA steel sheet subjected to alkali pretreatment.

In view of the situation described above, the present invention characteristically carries out both rolling with a dull roll and rolling with a bright roll in temper rolling.

A coating surface of a GI steel sheet subjected to temper rolling using a dull roll is imparted with irregularities by the temper rolling such that the irregularities include recessed portions which have been activated due to removal of Al oxide therefrom and protruding portions (other than the recessed portions) which have not been activated due to failure in removing Al oxide therefrom, as described above. The GI steel sheet in this state is then subjected to further temper rolling using a bright roll, such that the protruding portions of the coating surface of the GI steel sheet are brought into contact with a roll surface of the bright roll and Al oxide on the protruding portions is physically removed. As a result, the Al oxide layer is removed from the substantially entire portion of the irregular coating surface of the GI steel sheet and thus the substantially entire portion of the irregular coating surface is activated. The coating surface of the GI steel sheet thus activated is then brought into contact with acidic solution, whereby a sufficiently thick zinc oxide layer can be formed on the coating surface at a sufficiently high coverage ratio.

In the case of a GA steel sheet, temper rolling using a bright roll, as well as a dull roll, described above achieves a larger amount of Al oxide removal and thus a higher degree of surface activity than the conventional temper rolling using a dull roll only.

The present invention will be described in detail hereinafter.

A steel sheet is subjected to hot dip galvanizing, optionally alloying after hot dip galvanizing, and then finally temper rolling in the present invention. Hot dip galvanizing and alloying may be carried out according to the conventional method.

The temper rolling is carried out as combination of rolling with a dull roll having Ra≥2.0 μm at rolling reduction rate ≤5% (which will occasionally be referred to as "dull rolling" hereinafter) and rolling with a bright roll having Ra≤0.1 μm at rolling reduction rate ≤3% (which will occasionally be referred to as "bright rolling" hereinafter). First the dull rolling and then the bright rolling may be carried out. Alternatively, first the bright rolling and then the dull rolling may be carried out. Carrying out both the dull rolling and the bright rolling as described above successfully removes Al oxide layers on substantially the entire coating surfaces of a galvanized steel sheet to such an extent that allows desired zinc oxide layers to be sufficiently formed on the coating surfaces.

The dull roll for dull rolling needs to have Ra≥2.0 μm because Ra<2.0 μm of the dull roll results in too small Ra of a surface of a resulting galvanized steel sheet after temper rolling, which may decrease coefficient of friction between the same galvanized steel sheets when they are handled in coiling process and significantly deteriorate handling properties of the steel sheet due to possible coil collapse or the like. Ra of the dull roll is preferably 5 μm or less in terms of sharpness of paint appearance, although the upper limit of Ra of the dull roll is not particularly limited. Rolling reduction rate of the dull rolling is to be ≤5% because the rolling reduction rate exceeding 5% decreases elongation of a steel sheet and adversely affects press formability thereof. Rolling reduction rate of the dull rolling is preferably ≥0.1% in order to eliminate yield point elongation, although the lower limit of the rolling reduction is not particularly limited.

The bright roll for bright rolling needs to have Ra≤0.1 μm because: portions of a coating surface which were not in contact with the dull roll in dull rolling are less likely to be brought into contact with the bright roll during bring rolling when Ra of the bright roll is >0.1 μm than otherwise in a case where bright rolling is carried out after dull rolling; or portions of a coating surface which were not in contact with the bright roll in bright rolling are less likely to be brought into contact with the dull roll during dull rolling when Ra of the bright roll is >0.1 μm than otherwise in a case where dull rolling is carried out after bright rolling, whereby Al oxide cannot be sufficiently removed. Ra of the bright roll is preferably at least 0.01 μm in terms of avoiding too much processing cost for the bright roll, although the lower limit of Ra of the bright roll is not particularly limited. Rolling reduction rate of the bright rolling is to be ≤3% because the rolling reduction rate exceeding 3% decreases elongation of a steel sheet and adversely affects press formability thereof. Rolling reduction rate of the bright rolling is preferably ≥0.1% in order to eliminate yield point elongation, although the lower limit of the rolling reduction is not particularly limited.

"Ra" represents arithmetic average roughness prescribed in JIS B0601-2001.

The method for manufacturing a hot dip galvanized steel sheet of the present invention includes: subjecting a steel sheet to hot dip galvanizing and subsequent temper rolling; bringing the steel sheet into contact with acidic solution having pH buffering capacity; retaining the steel sheet for 1 second to 60 seconds after the contact with the acidic solution; rinsing the steel sheet with water; and drying the steel sheet, to form a zinc oxide layer on a coating surface of the steel sheet. A zinc oxide layer having excellent sliding properties can be stably formed on a flat portion of a coating surface of a galvanized steel sheet by using acidic solution having pH buffering capacity.

The mechanism of zinc oxide layer formation described above is not clear but presumably as follows. Zinc dissolves from a hot dip galvanized steel sheet when the hot dip galvanized steel sheet is brought into contact with acidic solution. The dissolution of zinc simultaneously triggers a hydrogen-generating reaction. This means that concentration of hydrogen ion in the acidic solution decreases as the dissolution of zinc proceeds, whereby pH of the solution increases and an oxide layer of mainly constituted of zinc is eventually formed on a coating surface of the hot dip galvanized steel sheet. If an acidic solution not having pH buffering capacity is used, the pH value of the solution instantly increases, whereby zinc fails to dissolve by an amount sufficient for oxide layer formation and thus zinc oxide layers fail to be formed by an amount sufficient for improving sliding properties. In contrast, use of an acidic solution having pH buffering capacity allows mild zinc dissolution, a mild hydrogen-generating reaction and thus relatively slow increase in pH of the solution, whereby zinc continues to be dissolved and zinc oxide sufficient for improving sliding properties is eventually formed.

The pH value of the acidic solution is preferably at least 1.0 because too low pH of the acidic solution inhibits formation of oxide, although dissolution of zinc is facilitated. However, the pH value of the acidic solution is preferably 5.0 or lower because too high pH of the acidic solution slows the rate of a dissolution reaction of zinc.

The acidic solution having pH buffering capacity preferably exhibits the pH buffering capacity in the pH range of 2.0 to 5.0. An oxide layer desired in the present invention can be stably formed on a galvanized steel sheet by using acidic solution exhibiting pH buffering capacity in the pH range of 2.0 to 5.0 and retaining the steel sheet for a predetermined time after the contact with the acidic solution.

The acidic solution having such pH buffering capacity as described above is preferably prepared by selecting at least one type of acid salt component from: acetic acid salt such as sodium acetate ($CH_3COONa$); phthalic acid salt such as potassium hydrogen phthalate ($(KOOC)_2C_6H_4$); citric acid salt such as sodium citrate ($Na_3C_6H_5O_7$) and potassium dihydrogen citrate ($KH_2C_6H_5O_7$); succinic acid salt such as sodium succinate ($Na_2C_4H_4O_4$); lactic acid salt such as sodium lactate ($NaCH_3CHOHCO_2$); tartaric acid salt such as sodium tartrate ($Na_2C_4H_4O_6$); boric acid salt; phosphoric acid salt; and sulfuric acid salt, and obtaining an aqueous solution containing the acid salt component(s) thus selected by 5 g/L to 50 g/L. Content of the acid salt component(s) lower than 5 g/L results in relatively quick increase in pH of the solution as zinc dissolves into the solution, thereby possibly making it difficult to form oxide layers by an amount sufficient for improving sliding properties. Content of the acid salt component(s) exceeding 50 g/L not only facilitates dissolution of zinc to undesirably prolong time required for oxide layer formation but also possibly causes such severe damage on a coating layer of a galvanized steel sheet that no longer allows the galvanized steel sheet to serve as a rust-proof steel sheet.

The method for bringing a hot dip galvanized steel sheet into contact with acidic solution is not particularly limited and examples of the method include: immersing a galvanized steel sheet in acidic solution; spraying acidic solution onto a galvanized steel sheet; coating a galvanized steel sheet with acidic solution by way of a coating roll; and the like. It is preferable that the acidic solution eventually exists in a state of thin liquid film on a steel sheet surface. In a case where weight of the acidic solution present on a surface of a galvanized steel sheet exceeds 15 g/m$^2$, pH of the solution fails to increase in spite of vigorous dissolution of zinc, which may prolong time required for oxide layer formation and cause such severe damage on a coating layer of the galvanized steel sheet that no longer allows the galvanized steel sheet to serve as a rust-proof steel sheet. Such a problem as described above can be effectively prevented by setting coating weight of liquid film of the acidic solution on a coating surface of a galvanized steel sheet when contact of the steel sheet with the acidic solution is completed to be 15 g/m$^2$ or less. The lower limit of the coating weight of the acidic solution is not particularly limited. However, the lower limit of coating weight of liquid film of the acidic solution on a coating surface of a galvanized steel sheet is preferably 15 g/m$^2$ because an oxide layer having desired thickness cannot be formed on a coating surface of a galvanized steel sheet when the coating weight of liquid film of the acidic solution is too small. Coating weight of liquid film of acidic solution can be adjusted by squeeze rolls, air wiping or the like. The aforementioned expression of "when contact of the steel sheet with the acidic solution is completed" represents completion of immersion in the case of immersing a galvanized steel sheet in acidic solution, completion of spraying in the case of spraying acid solution onto a galvanized steel sheet, and completion of coating in the case of coating a galvanized steel sheet with acidic solution by way of a coating roll.

The galvanized steel sheet need be retained for 1 second to 60 seconds after completion of contact thereof with acidic solution before being rinsed with water (that is, retention time of the galvanized steel sheet treated with acidic solution, prior to water rinsing, is 1 second to 60 seconds). The retention time shorter than 1 second results in failure in improving sliding properties because acidic solution is then rinsed off before pH of the solution increases high enough to allow an oxide layer mainly constituted of zinc to be formed. The retention time longer than 60 seconds is meaningless because then an amount of an oxide layer eventually formed on a coating surface reaches a plateau.

A zinc oxide layer can be stably and effectively formed on a coating surface of a hot dip galvanized steel sheet by satisfying the manufacturing conditions described above.

The galvanized steel sheet subjected to temper rolling may be brought into contact with alkali solution prior to being brought into contact with acidic solution for formation of an oxide layer. There is a possibility that some of aluminum oxide remains on a coating surface of a galvanized steel sheet after temper rolling, although most of the aluminum oxide has been destroyed by contact thereof with rolling rolls during the temper rolling. Layers of such Al oxide remaining on a surface layer of a galvanized steel sheet can be removed and the surface layer can be further activated by bringing the surface layer into contact with alkali solution. The method for bringing a surface layer of a galvanized steel sheet into contact with alkali solution is not particularly restricted and example thereof include immersion, spraying and the like. The pH value of alkali solution is preferably at least 10 because too low pH value of alkali solution slows the reaction rate to prolong processing time. Types of alkali solution is not particularly limited as long as pH thereof is in the aforementioned range. Sodium hydroxide solution, for example, can be used.

Acidic solution remaining on a surface of a steel sheet surface after rinsing with water and drying thereof facilitates generation of rust in a case where the steel sheet is stored in a coiled state for a relatively long period. It is acceptable in terms of preventing such rust from being generated to carry out a process for neutralizing acidic solution remaining on a surface of a steel sheet by bringing the steel sheet into contact with alkali solution through immersion of the steel sheet in alkali solution or spraying alkali solution onto the steel sheet. The alkali solution preferably has pH of 12 or lower in order to avoid dissolution of zinc oxide formed on a coating surface of a galvanized steel sheet. Type of the alkali solution is not particularly limited as long as pH thereof is equal to 12 or lower and examples thereof include solutions of sodium hydroxide, sodium phosphate and the like.

The term "zinc oxide" represents oxide/hydroxide of which metal component is mainly zinc in the present invention. The "zinc oxide" of the present invention include: oxide/hydroxide containing not only zinc but also other metal components, e.g. Fe, Al such that the total content of the non-Zn metal components is lower than Zn content; and oxide/hydroxide containing not only $O^{2-}/OH^{-}$ but also other anions such as $SO_4^{2-}$, $NO_3^{-}$ and $Cl^{-}$ such that the total number of moles of anions other than $O^{2-}/OH^{-}$ is lower than the number of mole of $O^{2-}/OH^{-}$. A resulting zinc oxide layer may contain an anion component such as $SO_4^{2-}$ used in the acidic solution for pH adjustment thereof. Specifically, the zinc oxide may contain: an anion component such as sulphate ion; impurities contained in the acidic solution having pH buffering capacity, e.g. S, N, P, B, Cl, Na, Mn, Ca, Mg, Ba, Sr and Si; and compounds containing S, N, P, B, Cl, Na, Mn, Ca, Mg, Ba, Sr, Si, O and C, unless presence thereof adversely affects the good effects of the present invention.

A hot dip galvanized steel sheet exhibits satisfactory sliding properties when an oxide layer formed on a coating surface layer thereof has thickness of at least 10 nm. The oxide layer has thickness of preferably at least 20 nm, more preferably at least 30 nm, in terms of obtaining good sliding properties in a stable manner. The oxide layer having thickness of preferably at least 20 nm, more preferably at least 30 nm, reliably remains on a surface layer of a galvanized steel sheet and thus prevents sliding properties of the galvanized steel sheet from deteriorating even after the oxide layer has been worn by press forming in which contact area between a die and the galvanized steel sheet to be formed is relatively large. The upper limit of thickness of the oxide layer is not particularly restricted. However, thickness of the oxide layer is preferably 200 nm because the oxide layer having thickness exceeding 20 nm tends to deteriorate reactivity of a surface of a galvanized steel sheet and rather decreases production yield of the zinc oxide film layer.

A galvanizing bath needs to contain Al added thereto in the method for manufacturing a hot dip galvanized steel sheet of the present invention. Elements or components other than Al, to be added to the galvanizing bath, are not particularly restricted. In other words, small amounts of Pb, Sb, Si, Sn, Mg, Mn, Ni, Ti, Li, Cu and the like, as well as Al, contained or added in the galvanizing bath do not adversely affect the good effects of the present invention as long as intended zinc oxide is appropriately formed.

EXAMPLES

Next, the present invention will be described further in detail by Examples.

Steel sheet samples each cold-rolled and then annealed (sheet thickness: 0.7 mm) were then subjected to hot dip galvanizing and optionally alloying treatment after the galvanizing according to the conventional method. Coating weight of zinc per one surface of each steel sheet sample was adjusted to 45 g/m$^2$ and Fe content in coating film after the alloying treatment of each steel sheet sample was adjusted to 10 mass %. Each steel sheet sample thus galvanized was then subjected to temper rolling. The temper rolling was carried out by employing at least one of "dull rolling" with a dull roll and "bright rolling" with a bright roll. Each of the galvanized steel sheet samples thus subjected to temper rolling was immersed in an acidic solution of pH 2.0 containing 30 g/L of sodium acetate in an acidic solution bath at 50° C. and removed from the bath. Coating weight of liquid film of the acidic solution to remain on each surface of the galvanized steel sheet sample was adjusted by squeeze rolls disposed on the exit side of the acidic solution bath. The coating weight of the acidic solution was adjusted by changing pressure of the squeeze rolls. After the coating weight of the acidic solution was thus adjusted, each of the galvanized steel sheet samples was left (retained) for 1 second to 60 seconds, rinsed by spraying warm water at 50° C. thereonto and dried by a drier, to cause a zinc oxide layer to be formed on a coating surface thereof. Some of the steel sheet samples were left (retained) for a predetermined time after the adjustment of coating weight of the acidic solution, then sprayed with an alkali solution (aqueous solution of sodium hydroxide) of pH 10 at 50° C. so that the acidic solution remaining on steel sheet surfaces was neutralized. These steel sheets were then rinsed with warm water at 50° C. Further, some of the steel sheet samples were subjected to only temper rolling, skipping the oxide formation process by bringing the steel sheet sample into contact with acidic solution after the temper rolling.

Thickness of an oxide layer formed on a coating surface layer of each of the galvanized steel sheet samples thus prepared, area ratio of oxide thus formed on the coating surface layer, sliding properties during press forming and handling properties of each galvanized steel sheet sample were analyzed. Sliding properties during press forming of the galvanized steel sheet sample were evaluated according to coefficient of friction and die galling properties.

Methods for measuring thickness of an oxide layer, area ratio of oxide thus formed, press formability (sliding properties and die galling properties), and coil handling properties of each galvanized steel sheet sample are as follows.

[1] Measurement of Thickness of Oxide Layer

Thickness of an oxide layer was measured by using a fluorescence X-ray analyzer. The voltage and current of a vacuum tube during the measurement were 30 kV and 100 mA, respectively, and TAP (thallium acid phthalate) was used as dispersive crystal for detection of O—Kα X-rays. Intensity at a background position, as well as intensity at a peak position, was measured in measurement of O—Kα X-rays, so that the net intensity of O—Kα rays was calculated. Integral time at a peak position and integral time at a background position were 20 seconds, respectively. Further, silicon wafers with oxide silicon coating layers formed thereon (layer thickness: 96 nm, 54 nm and 24 nm, respectively), each cleaved into an appropriate size, were analyzed as references at the same time in the measurement. Thickness of a target zinc oxide layer was then determined by calculation based on the relationship between the intensities of O—Kα X-rays thus measured and the thicknesses of silicon oxide coating layers of the respective silicon wafers.

[2] Measurement of Area Ratio of Oxide Formed on Coating Surface

Area ratio (%) of oxide formed on a coating surface of each galvanized steel sheet sample was determined by: photographing arbitrary ten fields (each 35 μm×45 μm) of the coating surface by using an ultra-low-voltage scanning electron microscope (SEM) at accelerating voltage of 3 kV; observing the SEM images (compositional images in BE mode) thus obtained to measure area ratio of portions where oxide had been formed, of the coating surface of the sample, based on difference in brightness between a portion where oxide had been formed and a portion where oxide had not been formed; calculating the average of the area ratios of portions where oxide had been formed, of the ten fields; and regarding the average as the area ratio (%) of oxide formed on a coating surface of the galvanized steel sheet sample.

[3] Method for Measuring Coefficient of Friction

Coefficient of friction of each galvanized steel sheet sample was measured for evaluation of press formability according to a method as described below.

FIG. 1 is a schematic front view showing a coefficient of friction tester. A sample (piece) 1 for coefficient of friction measurement, collected from each galvanized steel sheet sample, is fixed on a sample table 2 and the sample table 2 is fixed on the upper surface of a slide table 3 adapted to be slidable in the horizontal direction, as shown in FIG. 1. A slide table support 5 having a roll 4 and movable in the vertical direction is provided under the slide table 3 such that the roll 4 is in contact with the lower surface of the slide table 3. A bead 6 is pushed against a surface of the sample 1 for coefficient of friction measurement by pushing-up the slide table 5. A first load cell 7 for measuring pressing load N exerted on the sample 1 for coefficient of friction measurement by the bead 6 is mounted on the slide table 5. A second load cell 8, for measuring sliding resistance force F experienced when the slide table 3 is moved in the horizontal direction in a state where the pressing load is exerted on the sample 1 for coefficient of friction measurement, is mounted on the slide table 3 at an end portion of the slide table. The surface of the sample 1 was coated with rust preventative cleansing oil (PRETON R352L®, manufactured by SUGIMURA Chemical Industrial Co., Ltd.) as lubricating oil before carrying out a test.

Figure 2:
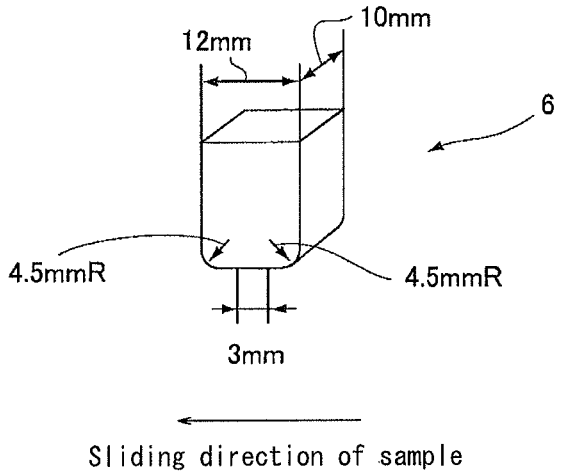
FIG. 2 is a schematic perspective view showing shape and dimension of a bead depicted in FIG. 1.
Figure 3:
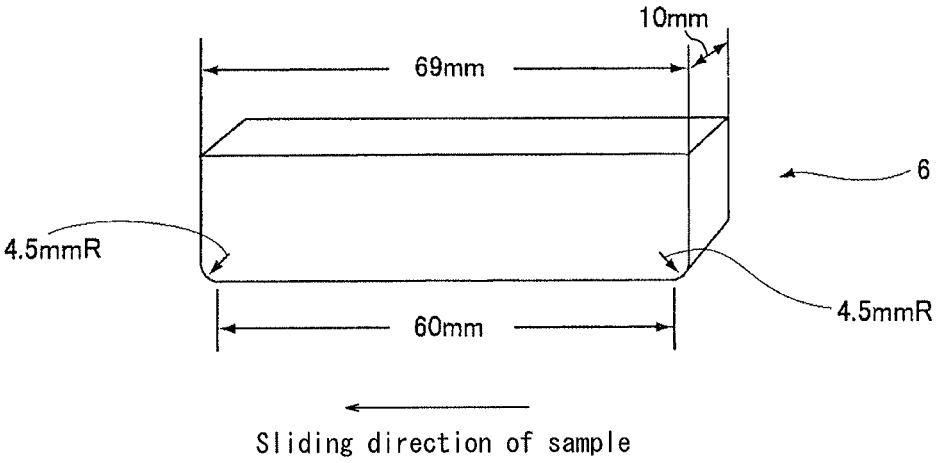
FIG. 3 is a schematic perspective view showing shape and dimension of a bead depicted in FIG. 1.

FIG. 2 and FIG. 3 are schematic perspective views showing shapes and dimensions of beads for use in tests, respectively. The sample 1 is slid in a state where the lower surface of the bead 6 is pushed against the surface of the sample 1. One bead 6 shown in FIG. 2 has dimensions including width: 10 mm, length in the sliding direction of sample: 12 mm, and radius of curvature at each lower end-side corner portion in the sliding direction: 4.5 mm R. The lower surface of the same bead 6 of FIG. 2, at which the bead is pushed against the sample 1, is a flat plane having width: 10 mm, and length in the sliding direction of sample: 3 mm. Another bead 6 shown in FIG. 3 has dimensions including width: 10 mm, length in the sliding direction of sample: 69 mm, and radius of curvature at each lower end-side corner portion in the sliding direction: 4.5 mm R. The lower surface of the same bead 6 of FIG. 3, at which the bead is pushed against the sample 1, is a flat plane having width: 10 mm, and length in the sliding direction of sample: 60 mm.

Measurement of coefficient of friction were carried out under two conditions described below.

[Condition 1]

Bead shown in FIG. 2, Pressing load N: 400 kgf, and Pull-out rate of sample (Transfer rate of the slide table 3 in the horizontal direction): 100 cm/min.

[Condition 2]

Bead shown in FIG. 3, Pressing load N: 400 kgf, and Pull-out rate of sample (Transfer rate of the slide table 3 in the horizontal direction): 20 cm/min.

Coefficient of friction μ between the sample and the bead was calculated according to formula: $\mu=F/N$

[4] Method for Evaluating Die Galling Properties

A GI steel sheet in particular has a problem of "die galling" in which coating of the steel sheet adheres to a die at a portion where the steel sheet is slid in a relatively long distance against the die. In view of this, "die galling" properties were evaluated for each of the GI steel sheet samples by using the coefficient of friction tester shown in FIG. 1, aside from the measurement of coefficient of friction, by: repeating sliding tests 50 times and determining the test-repetition number when the coefficient of friction increased by 0.01 or more; and regarding the test-repetition number thus determined as the limit repetition number of die galling. The sliding tests were carried out under Condition 1 and Condition 2 described above in the same manner as the method for measuring coefficient of friction of [3] above.

[5] Method for Evaluating Handling Properties

A method for evaluating handling properties of each galvanized steel sheet sample in a coiled state thereof through simulation include: holding the steel sheet sample between a bead and the load cell via the slide table in the coefficient of friction tester such that a constant pressing load was exerted on the steel sheet sample; and measuring pull-out load to calculate the value of coefficient of friction. Specifically, an additional sample piece was collected from the galvanized steel sheet sample and pasted to the lower surface of the bead, so that coefficient of friction of an overlapping portion between one sample piece and the other sample piece was measured. The measurement conditions included bead dimension: 30 mm (width)×35 mm (length), contact pressure: 0.5 MPa, and pull-out rate: 50 mm/min. Coefficient of friction <0.08 was evaluated to be poor ("x") and coefficient of friction 0.08 was evaluated to be good ("○") because it has been revealed from the discoveries in the past that problems do not arise in terms of handling properties of a galvanized steel sheet in a coiled state when the coefficient of friction thereof thus measured is equal to or larger than 0.08.

The results thus obtained, as well as the corresponding conditions, are shown in Table 1 and Table 2.

[Table 1]

[Table 2]

The following conclusions are reasonably drawn from Table 1 and Table 2.

(1) GI: Samples Nos. 1-31

Samples Nos. 12-15, 17-20, 22-24 and 26-31 as Examples according to the present invention, subjected to both rolling with a dull roll and rolling with a bright roll and subsequent oxide formation process through contact with acidic solution, each exhibited: higher area ratio of oxide formed on a coating surface and thicker oxide layer, thereby achieving lower coefficient of friction, larger limit test-repetition number before occurrence of die galling and better press formability; and also better handling properties in a coiled state, thereby safely avoiding problematic coil collapse, than Samples Nos. 1 and 6 as Comparative Examples which were each subjected to only one of rolling with a dull roll and rolling with a bright roll and skipped the subsequent oxide formation process, Samples Nos. 2-5 and 7-10 as Comparative Examples which were each subjected to only one of rolling with a dull roll and rolling with a bright roll and then the subsequent oxide formation process through contact with acidic solution, and Samples Nos. 11 and 16 as Comparative Examples which were each subjected to both rolling with a dull roll and rolling with a bright roll but skipped the subsequent oxide formation process. Sample No. 21 as a Comparative Example, subjected to both temper rolling with a dull roll and temper rolling with a bright roll (the conditions of temper rolling with a bright roll, however, was beyond the scope of the present invention) and subsequent oxide formation process through contact with acidic solution, exhibited poorer press formability than the corresponding Examples having the equivalent retention time (30 seconds) prior to water rinsing after completion of contact with acidic solution. Further, Sample No. 25 as a Comparative Example, subjected to both temper rolling with a dull roll and temper rolling with a bright roll (the conditions of temper rolling with a dull roll, however, was beyond the scope of the present invention) and subsequent oxide formation process through contact with acidic solution, exhibited poorer handling properties in a coiled state than the corresponding Examples having the equivalent retention time (30 seconds) prior to water rinsing after completion of contact with acidic solution, although press formability of Sample No. 25 was substantially equal to that of the corresponding Examples.

(2) GA: Samples Nos. 32-51

Samples Nos. 33-36, 42-44 and 46-51 as Examples according to the present invention, subjected to both rolling with a dull roll and rolling with a bright roll and subsequent oxide formation process through contact with acidic solution, each exhibited: thicker oxide layer and higher area ratio of oxide formed on a coating surface, thereby achieving lower coefficient of friction; and also better handling properties in a coiled state, thereby safely avoiding problematic coil collapse, than Samples Nos. 37 and 39 as Comparative Examples which were each subjected to only one of rolling with a dull roll and rolling with a bright roll and skipped the subsequent oxide formation process, Samples Nos. 38 and 40 as Comparative Examples which were each subjected to only one of rolling with a dull roll and rolling with a bright roll and then the subsequent oxide formation process through contact with acidic solution, and Sample No. 32 as a Comparative Example which was subjected to both rolling with a dull roll and rolling with a bright roll but skipped the subsequent oxide formation process. Sample No. 41 as a Comparative Example, subjected to both temper rolling with a dull roll and temper rolling with a bright roll (the conditions of temper rolling with a bright roll, however, was beyond the scope of the present invention) and subsequent oxide formation process through contact with acidic solution, exhibited poorer sliding properties than the corresponding Examples having the equivalent retention time (30 seconds) prior to water rinsing after completion of contact with acidic solution. Further, Sample No. 45 as a Comparative Example, subjected to both temper rolling with a dull roll and temper rolling with a bright roll (the conditions of temper rolling with a dull roll, however, was beyond the scope of the present invention) and subsequent oxide formation process through contact with acidic solution, exhibited poorer handling properties in a coiled state than the corresponding Examples having the equivalent retention time (30 seconds) prior to water rinsing after completion of contact with acidic solution, although sliding properties of Sample No. 45 was substantially equal to that of the corresponding Examples.

INDUSTRIAL APPLICABILITY

According to the method for manufacturing a hot dip galvanized steel sheet of the present invention, it is possible to stably form by carrying out an adequate temper rolling process a zinc oxide layer having excellent sliding properties on a GI steel sheet surface exhibiting a relatively low degree of surface activity, through zinc oxide layer formation process after the temper rolling without necessitating an alkali pretreatment. Further, it is possible to obtain adequate surface roughness Ra of the hot dip galvanized steel sheet according the present invention. As a result, it is possible to provide a hot dip galvanized steel sheet excellent in press formability and handling properties in a coiled state. Yet further, it is possible to increase both area ratio and layer thickness of a zinc oxide layer formed on a coating surface of a GI/GA galvanized steel sheet (this good effect can be obtained in both of a GI steel sheet and a GA steel sheet) according to the present invention, thereby making it possible to manufacture a hot dip galvanized steel sheet having further improved sliding properties during press forming.

EXPLANATION OF REFERENCE NUMERALS

1 Sample for Coefficient of friction measurement
2 Sample table
3 Slide table
4 Roll
5 Slide table support
6 Bead
7 First load cell
8 Second load cell
9 Rail
N Pressing load
F Sliding resistance force

TABLE 1

| | | First temper rolling | | | Second temper rolling | | | | Liquid film | Retention |
|---|---|---|---|---|---|---|---|---|---|---|
| | | Roll specifications | | | Roll specifications | | | | weight ($g/m^2$) at | time prior |
| Steel sample ID | Coating type | Roll type | Surface roughness Ra | Rolling reduction rate | Roll type | Surface roughness Ra | Rolling reduction rate | Contact with acidic solution | completion of contact with acidic solution | to water-rinsing (s) |
| 1 | Galvanized steel sheet (GI) | Dull roll | 2.1 μm | 0.7% | | Not carried out | | Not carried out | 5 $g/m^2$ | — |
| 2 | | | | | | | | Sulfric acid + sodium acetate 30 g/L pH 2.0 50° C. | | 1 |
| 3 | | | | | | | | | | 10 |
| 4 | | | | | | | | | | 30 |
| 5 | | | | | | | | | | 60 |
| 6 | | Bright | 0.1 μm | 1.0% | | Not carried out | | Not carried out | | — |

TABLE 1-continued

| | | | | | | | | |
|---|---|---|---|---|---|---|---|---|
| 7 | roll | | | | | | Sulfric acid + | 1 |
| 8 | | | | | | | sodium acetate | 10 |
| 9 | | | | | | | 30 g/L | 30 |
| 10 | | | | | | | pH 2.0 50° C. | 60 |
| 11 | Dull | 2.1 μm | 0.7% | Bright | 0.1 μm | 1.0% | Not carried out | — |
| 12 | roll | | | roll | | | Sulfric acid + | 1 |
| 13 | | | | | | | sodium acetate | 10 |
| 14 | | | | | | | 30 g/L | 30 |
| 15 | | | | | | | pH 2.0 50° C. | 60 |
| 16 | Bright | 0.1 μm | 1.0% | Dull | 2.1 μm | 0.7% | Not carried out | — |
| 17 | roll | | | roll | | | Sulfric acid + | 1 |
| 18 | | | | | | | sodium acetate | 10 |
| 19 | | | | | | | 30 g/L | 30 |
| 20 | | | | | | | pH 2.0 50° C. | 60 |
| 21 | Dull | 2.1 μm | 0.7% | Bright | 0.2 μm | 1.0% | Sulfric acid + | 30 |
| 22 | roll | | | roll | 0.1 μm | | sodium acetate | 30 |
| 23 | | | | | 0.05 μm | | 30 g/L | 30 |
| 24 | | | | | 0.01 μm | | pH 2.0 50° C. | 30 |
| 25 | Dull | 1.5 μm | 0.7% | Bright | 0.1 μm | 1.0% | Sulfric acid + | 30 |
| 26 | roll | 2.1 μm | | roll | | | sodium acetate | 30 |
| 27 | | 3.0 μm | | | | | 30 g/L | 30 |
| 28 | | 4.0 μm | | | | | pH 2.0 50° C. | 30 |
| 29 | Dull | 2.1 μm | 0.7% | Bright | 0.1 μm | 1.0% | Sulfric acid + | 30 |
| 30 | roll | 3.0 μm | | roll | | | sodium acetate | 30 |
| 31 | | 4.0 μm | | | | | 30 g/L | 30 |
| | | | | | | | pH 2.0 50° C. | |

| | | | | Press formability | | | | | |
|---|---|---|---|---|---|---|---|---|---|
| | | | Area ratio of | | | Die galling properties | | | |
| Steel sample ID | Neutralizing treatment | Thickness of oxide layer (nm) | oxide formed on coating surface (%) | Sliding properties (Coefficient of friction) Condition 1 | Condition 2 | Condition 1 (Test-repetition number) | Condition 2 (Test-repetition number) | Handling properties in coiled state | Note |
| 1 | Not carried out | 8.9 | — | 0.110 | 0.320 | 4 | 1 | ○ | Comp. Example |
| 2 | | 12.5 | 30 | 0.106 | 0.253 | 5 | 1 | ○ | Comp. Example |
| 3 | | 16.9 | 30 | 0.100 | 0.184 | 6 | 1 | ○ | Comp. Example |
| 4 | | 20.2 | 30 | 0.093 | 0.175 | 7 | 1 | ○ | Comp. Example |
| 5 | | 25.6 | 30 | 0.090 | 0.162 | 7 | 2 | ○ | Comp. Example |
| 6 | | 10.6 | — | 0.103 | 0.160 | 4 | 1 | ○ | Comp. Example |
| 7 | | 16.5 | 40 | 0.099 | 0.159 | 6 | 1 | ○ | Comp. Example |
| 8 | | 18.9 | 40 | 0.095 | 0.156 | 7 | 1 | ○ | Comp. Example |
| 9 | | 23.6 | 40 | 0.092 | 0.152 | 7 | 2 | ○ | Comp. Example |
| 10 | | 29.8 | 40 | 0.089 | 0.150 | 7 | 2 | ○ | Comp. Example |
| 11 | | 12.3 | — | 0.103 | 0.160 | 4 | 1 | ○ | Comp. Example |
| 12 | | 35.9 | 95 | 0.079 | 0.146 | 8 | 3 | ○ | Example |
| 13 | | 59.8 | 95 | 0.050 | 0.130 | 11 | 5 | ○ | Example |
| 14 | | 70.5 | 95 | 0.048 | 0.129 | 15 | 6 | ○ | Example |
| 15 | | 92.2 | 95 | 0.047 | 0.127 | 20 | 6 | ○ | Example |
| 16 | | 12.6 | — | 0.110 | 0.200 | 4 | 1 | ○ | Comp. Example |
| 17 | | 34.6 | 95 | 0.080 | 0.165 | 8 | 4 | ○ | Example |
| 18 | | 60.5 | 95 | 0.051 | 0.130 | 12 | 5 | ○ | Example |
| 19 | | 82.1 | 95 | 0.049 | 0.128 | 16 | 6 | ○ | Example |
| 20 | | 93.6 | 95 | 0.046 | 0.125 | 21 | 6 | ○ | Example |
| 21 | | 25.6 | 50 | 0.092 | 0.152 | 7 | 2 | ○ | Comp. Example |
| 22 | | 70.5 | 95 | 0.048 | 0.129 | 15 | 6 | ○ | Example |
| 23 | | 70.6 | 95 | 0.047 | 0.130 | 15 | 6 | ○ | Example |
| 24 | | 70.9 | 95 | 0.048 | 0.128 | 15 | 6 | ○ | Example |
| 25 | | 72.3 | 95 | 0.048 | 0.129 | 15 | 6 | X | Comp. Example |
| 26 | | 70.5 | 95 | 0.048 | 0.129 | 15 | 6 | ○ | Example |
| 27 | | 71.2 | 95 | 0.047 | 0.129 | 15 | 6 | ○ | Example |
| 28 | | 71.3 | 95 | 0.046 | 0.126 | 15 | 6 | ○ | Example |
| 29 | Carried out | 70.5 | 95 | 0.048 | 0.129 | 15 | 6 | ○ | Example |
| 30 | | 71.2 | 95 | 0.047 | 0.129 | 15 | 6 | ○ | Example |
| 31 | | 71.3 | 95 | 0.046 | 0.126 | 15 | 6 | ○ | Example |

TABLE 2

| Steel sample ID | Coating type | First temper rolling: Roll specifications: Roll type | First temper rolling: Roll specifications: Surface roughness Ra | First temper rolling: Rolling reduction rate | Second temper rolling: Roll specifications: Roll type | Second temper rolling: Roll specifications: Surface roughness Ra | Second temper rolling: Rolling reduction rate | Contact with acidic solution | Liquid film weight ($g/m^2$) at completion of contact with acidic solution | Retention time prior to water-rinsing (s) |
|---|---|---|---|---|---|---|---|---|---|---|
| 32 | Galvannealed steel sheet (GA) | Dull roll | 2.1 μm | 0.7% | Bright roll | 0.1 μm | 1.0% | Not carried out | 5 $g/m^2$ | — |
| 33 | | | | | | | | Sulfric acid + sodium acetate 30 g/L pH 2.0 50° C. | | 1 |
| 34 | | | | | | | | | | 10 |
| 35 | | | | | | | | | | 30 |
| 36 | | | | | | | | | | 60 |
| 37 | | Dull roll | 2.1 μm | 0.7% | | Not carried out | | Not carried out | | — |
| 38 | | | | | | | | Sulfric acid + sodium acetate 30 g/L pH 2.0 50° C. | | 30 |
| 39 | | Bright roll | 0.1 μm | 1.0% | | Not carried out | | Not carried out | | — |
| 40 | | | | | | | | Sulfric acid + sodium acetate 30 g/L pH 2.0 50° C. | | 30 |
| 41 | | Dull roll | 2.1 μm | 0.7% | Bright roll | 0.2 μm | 1.0% | Sulfric acid + sodium acetate 30 g/L pH 2.0 50° C. | | 30 |
| 42 | | | | | | 0.1 μm | | | | 30 |
| 43 | | | | | | 0.05 μm | | | | 30 |
| 44 | | | | | | 0.01 μm | | | | 30 |
| 45 | | Dull roll | 1.5 μm | 0.7% | Bright roll | 0.1 μm | 1.0% | Sulfric acid + sodium acetate 30 g/L pH 2.0 50° C. | | 30 |
| 46 | | | 2.1 μm | | | | | | | 30 |
| 47 | | | 3.0 μm | | | | | | | 30 |
| 48 | | | 4.0 μm | | | | | | | 30 |
| 49 | | Dull roll | 2.1 μm | 0.7% | Bright roll | 0.1 μm | 1.0% | Sulfric acid + sodium acetate 30 g/L pH 2.0 50° C. | | 30 |
| 50 | | | 3.0 μm | | | | | | | 30 |
| 51 | | | 4.0 μm | | | | | | | 30 |

| Steel sample ID | Neutralizing treatment | Thickness of oxide layer (nm) | Area ratio of oxide formed on coating surface (%) | Press formability: Sliding properties (Coefficient of friction): Condition 1 | Press formability: Sliding properties (Coefficient of friction): Condition 2 | Press formability: Die galling properties: Condition 1 (Test-repetition number) | Press formability: Die galling properties: Condition 2 (Test-repetition number) | Handling properties in coiled state | Note |
|---|---|---|---|---|---|---|---|---|---|
| 32 | Not carried out | 11.9 | — | 0.140 | 0.182 | — | — | ○ | Comp. Example |
| 33 | | 30.2 | 95 | 0.112 | 0.153 | — | — | ○ | Example |
| 34 | | 42.5 | 95 | 0.110 | 0.148 | — | — | ○ | Example |
| 35 | | 55.6 | 95 | 0.105 | 0.145 | — | — | ○ | Example |
| 36 | | 62.3 | 95 | 0.103 | 0.143 | — | — | ○ | Example |
| 37 | | 8.9 | — | 0.140 | 0.182 | — | — | ○ | Comp. Example |
| 38 | | 25.8 | 40 | 0.125 | 0.175 | — | — | ○ | Comp. Example |
| 39 | | 10.6 | — | 0.140 | 0.182 | — | — | ○ | Comp. Example |
| 40 | | 27.9 | 50 | 0.099 | 0.159 | — | — | ○ | Comp. Example |
| 41 | | 36.8 | 70 | 0.111 | 0.149 | — | — | ○ | Comp. Example |
| 42 | | 55.6 | 95 | 0.105 | 0.145 | — | — | ○ | Example |
| 43 | | 55.3 | 95 | 0.107 | 0.146 | — | — | ○ | Example |
| 44 | | 56.2 | 95 | 0.109 | 0.143 | — | — | ○ | Example |
| 45 | | 56.3 | 95 | 0.106 | 0.146 | — | — | X | Comp. Example |
| 46 | | 55.6 | 95 | 0.105 | 0.145 | — | — | ○ | Example |
| 47 | | 55.4 | 95 | 0.106 | 0.142 | — | — | ○ | Example |
| 48 | | 56.2 | 95 | 0.108 | 0.146 | — | — | ○ | Example |
| 49 | Carried out | 55.6 | 95 | 0.105 | 0.145 | — | — | ○ | Example |
| 50 | | 55.4 | 95 | 0.106 | 0.142 | — | — | ○ | Example |
| 51 | | 56.2 | 95 | 0.108 | 0.146 | — | — | ○ | Example |

The invention claimed is:

1. A method for manufacturing a hot dip galvanized steel sheet comprising: subjecting a steel sheet to hot dip galvanizing and subsequent temper rolling; bringing the steel sheet into contact with acidic solution having pH buffering capacity; retaining the steel sheet for 1 second to 60 seconds after the contact with the acidic solution; and rinsing the steel sheet with water, to form a zinc oxide layer on a coating surface of the steel sheet, wherein the method further comprising:

carrying out the temper rolling by either rolling the steel sheet first with a dull roll having Ra≥2.0 μm at rolling reduction rate ≤5% and then with a bright roll having R≤0.1 μm at rolling reduction rate ≤3% or rolling the steel sheet first with a bright roll having Ra≤0.1 μm at rolling reduction rate ≤3% and then with a dull roll having Ra≥2.0 μm at rolling reduction rate 5%.

2. The method for manufacturing a hot dip galvanized steel sheet of claim 1, wherein the acidic solution having pH buffering capacity is an acidic solution containing at least one substance selected from acetic acid salt, phthalic acid salt, citric acid salt, succinic acid salt, lactic acid salt, tartaric acid salt, boric acid salt, phosphoric acid salt and sulfuric acid salt, and pH of the acidic solution is in the range of 1.0 to 5.0.

3. The method for manufacturing a hot dip galvanized steel sheet of claim 1 or 2, further comprising:

setting coating weight of liquid film of the acidic solution having pH buffering capacity on the coating surface of the steel sheet when contact of the steel sheet with the acidic solution is completed to be 15 $g/m^2$ or less.

4. The method for manufacturing a hot dip galvanized steel sheet of claim 1 or 2, further comprising:

subjecting a coating layer of the galvanized steel sheet to alloying treatment and then the temper rolling as described in claim 1.

5. The method for manufacturing a hot dip galvanized steel sheet of claim 1, wherein the temper rolling is carried out by rolling the steel sheet first with a dull roll having Ra≥2.0 μm at rolling reduce rate ≤5% and then with a bright roll having Ra≤0.1 μm at rolling reduction rate 3%.

* * * * *